US007393073B2

(12) United States Patent
Zach

(10) Patent No.: US 7,393,073 B2
(45) Date of Patent: Jul. 1, 2008

(54) MULTI-PRINTHEAD DIGITAL PRINTER

(76) Inventor: Moshe Zach, 67 Bar Cochva Street, Tel Aviv 64333 (IL)

( * ) Notice: Subject to any disclaimer, the term of this patent is extended or adjusted under 35 U.S.C. 154(b) by 0 days.

(21) Appl. No.: 10/327,116

(22) Filed: Dec. 24, 2002

(65) Prior Publication Data

US 2004/0036726 A1 Feb. 26, 2004

(30) Foreign Application Priority Data

Aug. 20, 2002 (IL) ..... 151354

(51) Int. Cl.
*B41J 29/38* (2006.01)

(52) U.S. Cl. ..... 347/12; 347/5; 347/40

(58) Field of Classification Search ..... 347/9–12, 347/19, 5, 20, 21, 39, 15, 14, 23, 24, 13, 347/38, 232, 2, 40–43, 85–86; 400/74; 358/296
See application file for complete search history.

(56) References Cited

U.S. PATENT DOCUMENTS

| | | | | |
|---|---|---|---|---|
| 4,576,490 | A | 3/1986 | Isobe | |
| 4,739,415 | A * | 4/1988 | Toyono et al. | 358/296 |
| 5,428,375 | A * | 6/1995 | Simon et al. | 347/12 |
| 5,742,300 | A * | 4/1998 | Klassen | 347/9 |
| 5,825,378 | A * | 10/1998 | Beauchamp | 347/19 |
| 5,864,349 | A * | 1/1999 | Hirabayashi et al. | 347/39 |
| 6,120,142 | A | 9/2000 | Eltgen et al. | |
| 6,208,365 | B1 * | 3/2001 | Nakamura et al. | 347/232 |
| 6,406,126 | B1 * | 6/2002 | Clark | 347/37 |
| 6,460,958 | B2 * | 10/2002 | Kubo et al. | 347/2 |

* cited by examiner

*Primary Examiner*—Lam S Nguyen
(74) *Attorney, Agent, or Firm*—Greer, Burns & Crain, Ltd.

(57) ABSTRACT

A digital printer having at least two printheads, that are operative to mark simultaneously on one or more media; each printhead including one or more printing devices and being operative to mark on the corresponding media one or more images within a respective non-overlapping window.

82 Claims, 3 Drawing Sheets

MULTI-PRINTHEAD DIGITAL PRINTER

FIELD OF THE INVENTION

This invention relates to digital printing and, in particular, to simultaneous printing of a plurality of images by a single printing machine.

BACKGROUND OF THE INVENTION

Digital printing presses and other digitally fed printing machines are widely used and are made in a great variety of types and models. They vary in terms of mechanical configuration, the basic process utilized for marking, the types and formats of media being printed and the nature of the printed images. These variables are inter-related. The present invention is applicable to printing machines of almost any type, all of which will be referred to hereinafter interchangeably as digital printers or just printers, and constitutes an improvement thereto, which may be advantageous for certain applications, as explained hereunder.

Common to all such printers is the presence of a medium to be imprinted and of a printhead. The media to be imprinted may consist of any of a variety of materials, including paper, cardboard, plastics, metal, textiles, ceramics, etc., and may have any of a variety of formats and sizes, including cut or rolled-up sheets, plates, tiles and formed products or parts thereof. A printhead includes a printing device, or an assembly of printing devices, that faces the medium and, under control of suitable signals, causes image-related marks to be left thereon. This process is referred to as marking or printing. The printhead is primarily classified by the basic type of the marking process and by the mode in which the marking proceeds. Marking generally involves some relative motion between the printhead and the medium in a plane parallel to the printed face of the medium. Generally this motion is along two orthogonal axes, usually being relatively fast along one axis, say X axis, (this motion also referred to as a sweep motion) and relatively slow along the other axis, say Y axis, (this motion being either continuous or stepwise), such a combined motion tracing a rectangular raster of lines. In the following description these motions will sometimes be referred to simply as "fast" and "slow" motions, respectively. However, for certain types of printheads and modes of marking it need be along only one axis, while for certain other types or modes it may be at similar rates along both axes (the trace not forming a raster). There will now be described examples of commonly used general types of printheads and their related marking processes and tracing modes.

The presently most ubiquitous marking process is known as the ink-jet process, which may be of two basic types—the so-called continuous ink jet (CIJ) process and the so-called drop-on-demand (DOD) process. An ink-jet printhead may include one or more ink-jet devices, each device emitting drops from one or more nozzles or apertures; in the case of a plurality of nozzles or apertures (which is prevalent for the DOD type), they usually form a regular array. Often, a plurality of ink-jet devices is assembled into a single printhead, forming a regular array, and if each device has an array of apertures, the assembly is such that all the arrays effectively combine into one large array of apertures. The effect of the array is that during the fast relative motion between the printhead and the medium along one axis, the marking by the several apertures is along corresponding parallel traces, which are usually equispaced and span the width of the printhead array. Generally, this width is much less than that of the image to be printed, so that a slow relative motion between the printhead and the medium is required also along the other axis to cover the whole width of the image. Also generally the spacing of the traces is coarser than the desired printing resolution; the slow motion along the other axis is then such that traces of consecutive sweeps become mutually interlaced. In certain types of digital presses (such as the Idanit digital press by Scitex Vision), the printhead is made to span the maximum width of the media and thus the slow motion serves only for interlacing of traces. Another type of marking device that requires two-axes motion, possibly in a non-raster mode, is an air brush. It is used for special low-resolution printing (or image-painting) applications.

A group of printing device types based on optical processes is also known. In these processes, marking is generally achieved in two stages: during a first (exposure) phase, one or more focused light beams, emerging from the printhead modulated by control signals, strike the medium or an intermediate surface, leaving thereon a latent image. During a second (development) stage, the latent image becomes a visible image on the medium. Two main types of exposure devices, and thus of optical printheads, are prevalent: the first main type consists of an array of modulated light sources, such as light-emitting diodes (LEDs); its mode of tracing is similar to that of an ink-jet array, generally requiring raster-like motion along both axes. The second main type has an intense beam of light, usually emanating from a laser, that is modulated and swept across the image area; here mechanical slow motion is required only along one axis. It is noted that the term light is used here to denote any focusable electromagnetic radiation and thus includes also ultra-violet and infra-red radiation. It is further noted that the marking process need not be based on photoelectric or photoconductive effects, but may for example be based on thermal effects.

Array-like printing devices using physical processes other than those discussed above are also known, such as those using direct thermal effects or direct electrostatic charging effects. Swept-beam printing devices using other than light beams, such as electron- or ion beams, are likewise known. Digital printers based on such and other devices are likewise subject to the improvements disclosed herein.

The marks left by the printing process on the medium may be any optically readable marks, such as those made by ink, paint or toner, or they may be any other material or effect on the medium, such as a varnish, a masking industrial layer or an etching, and the like. In the case of optically readable marks, the several devices in a printhead may include devices that mark in different colors. This is especially true for ink-jet (as well as air-brush) printing, where the inks themselves are colored. Such inks may be in the four primary printing colors or have any other desirable colors and constituent materials, including metallic and fluorescent materials. Digital printers based on such and other printing processes are likewise subject to the improvements disclosed herein.

Printers are mechanically differentiated by the manner in which the relative motion of the printhead and medium are carried out. There are three basic mechanical arrangements related to such motion. In a first arrangement, the medium is stationary during the printing of an image and the printhead is generally movable along the two orthogonal axes—usually in a relatively fast motion along the X axis and in a relatively slow motion along the Y axis. Often the medium is a sheet or a plate that lies flat, in which case this arrangement is also termed flat-bed printer. In the case of a swept-beam type of printhead, the sweep assumed to be along the X axis, there is only a slow mechanical motion along the Y axis. In the case of an array-type printhead that spans the entire maximal width of a printed image, the motion along the Y axis need only be for trace interlacing, as explained above. Any motion of a printhead during marking will be referred to as a marking motion.

In a second mechanical arrangement, the medium moves slowly along the Y axis, while the printhead generally moves repeatedly along the X axis, in a relatively fast motion. In the case of a swept-beam type of printhead, the printhead is stationary, the sweep being aligned with the X axis. Digital printers of this second basic arrangement vary according to whether the printed medium is flexible or rigid, and if flexible—whether it is in the form of a plurality of separate sheets or formed into a very long sheet, also known as a web. The case of a rigid medium also includes flexible media, such as one or more garments, that are attached to, or mounted on, a rigid substrate. A rigid medium or substrate is usually flat and during printing moves parallel to one of its coordinates; this may be regarded as another configuration of a flat-bed printer. A rigid medium or substrate may, however, also have another convenient shape, such as a cylinder; in the latter case it slowly rotates around its axis, while the printhead moves fast parallel to the axis of rotation. A web-formed medium moves from reel to reel, past a printing station, by means of rollers; at the printing station it is stretched to become planar or is made to run in contact with a backing surface. A flexible sheet is moved past a printing station either by means of rollers or temporarily attached to a substrate, which may be flexible (such as an endless belt) or rigid (such as a cylinder).

In a third mechanical arrangement, it is the medium that moves fast, e.g. attached to a rotating cylinder, while the printhead generally moves in a relatively slow motion. If the printhead includes an array that spans the width of the printed image, the slow motion need only be for trace interlacing, as explained above. It will be appreciated that a fourth basic mechanical arrangement is theoretically possible, though generally not practical nor known to be practiced, namely a stationary printhead with a medium moving along both orthogonal axes; the invention is applicable to such an arrangement, as well as to all the others mentioned hereabove, with obvious modifications, which would, moreover, be relatively simple to embody.

For each of the above arrangements there are known a variety of ways for loading the medium (i.e. bringing the medium into the general area of printing), moving it during marking and unloading it (i.e. taking the medium out of that area). In the cases of a rigid medium, or substrate, and a sheet-formed flexible medium, the motions required for loading and unloading are distinct from, and generally faster than, the aforementioned slow motion during marking. In the case of a web-formed medium all three motions have the same average rate but may be separately controlled; this is particularly apparent if the motion for marking is stepwise. There also is a possibility that the printer is but one station in a production line, where other stations may include similar printers or may involve other processes. In a configuration involving a web, the web may then continuously run into the printer from a preceding workstation and out of the printer into the next workstation. In configurations involving sheets or plates (including the case of substrates that carry pieces to be printed), the latter may be moved from one station to another, for example, in a round-robin fashion, whereby one or two stations may serve to load and unload the pieces or the substrates. It is noted that flat-bed configurations are useful for printing a large variety of media, particularly rigid ones or such that consist of fabricated pieces attached to a substrate. For any of the above ways of moving the media, the present invention is applicable with respect to the motion of the media during the marking process.

There are applications in which it is required to print, or image-wise paint, curved surfaces. These may, for example, be outside surfaces of various objects that cannot be fabricated by cutting, folding and gluing a flat medium (e.g. cardboard). To this end, a printer of any of the arrangements discussed above may be modified to allow relative motion between the printhead and the medium also along a third orthogonal axis, say—the Z axis. The motion along the Z axis is then controlled so that the distance between the printhead and the area of the medium being imprinted remains constant.

Essentially all printers of prior art are equipped, and designed to function, with a single printhead. The term printhead in this context is to be understood as any printhead of the types described hereabove, and similar ones, characterized by being mechanically a single assembly and operative to mark essentially the entire printable area of the medium, while the latter is in the printing position. Typically, the printhead gradually marks an entire image, as the aforementioned relative motion between it and the medium takes place. If the printhead includes an array of marking devices, they are arranged so as to mark parallel traces that are relatively close to each other and, as noted above, successive sweeps generally cause these traces to interlace. In the case of multiple color devices in a single printhead, they are generally arranged so that their traces overlap each other on successive sweeps.

There are many applications in which a plurality of separate images, often identical ones, need to be printed on a single medium. The multiplicity may be along the X axis, along the Y axis or along both. This need arises particularly where an array of discrete pieces of print media must be printed. Typical examples are decorative tiles, T-shirts, peel-and-stick labels. Yet other examples are multiple copies of a poster or leaflet, as well as of pages of a book, to be printed on a single sheet.

Clearly, all such printing jobs can be carried out in conventional single-printhead printers, by suitably programming the control signals. Such an operation may have two drawbacks: first, in many cases there are relatively large spaces between the printed pieces or between the page images, in which no marking is to take place; the time during which the printhead sweeps over these spaces is wasted—resulting in reduced utility of the printer. While speeding up the motion of the printhead or of the medium over these spaces is theoretically possible, it may not be practical, because of the high rates of acceleration and deceleration required. Secondly, since the multiple images are marked sequentially, the time it takes to mark all of them is that multiple of the time that it takes to mark any one of them, so that marking them sequentially using a single printhead is disadvantageous relative to marking several images simultaneously using multiple printheads.

The overall printing rate of a given printer may generally be increased by increasing the sweeping speed during marking or by increasing the number of printing devices operating simultaneously. The sweeping speed is ultimately limited by mechanical considerations and by the maximal marking rate of each device. Increasing the number of marking devices in a printhead would result in an increased number of traces marked per sweep. This would require, with respect to the Y axis, a commensurate increase in speed, in the case of continuous motion, or a commensurate increase in the step size; in either case, the mechanical precision required to maintain alignment between successive sweeps may be taxed. If the number of marking devices in the printhead is increased to span the whole width of the medium (thus requiring very little motion, if any, along the Y axis, as is the case in certain printers of the third basic arrangement, as explained above), there may be a considerable number of devices (or portions of such devices) that trace only spaces between images and therefore represent a wasteful investment.

In the case of curved surfaces to be printed, which requires also motion along the Z axis, there is a limitation on the size and number of printing devices in any one printhead: it must be small enough for the distance that is maintained between the printhead and the curved surface to be practically the same for all the devices and apertures.

It is further noted that in multiple-image applications, the size of the images, as well as the width of the gaps between them, may be variable—both between jobs and between images on the same sheet. Overcoming the investment inefficiency of a full-width array printhead, as suggested hereabove, by leaving out some of the marking devices, would be impractical in view of this variability.

It is furthermore noted that in some multiple-image applications, the various images may have to be printed on different media; for example, a batch of T-shirts to be imprinted may include samples made of different materials, or as another example, a fabricated object may include parts made of different materials. Such different media would need suitably different types of printing devices or inks and thus could not be printed by a single printhead in a single operation. Using a conventional printer, the job will have to be done in several runs—possibly on different printers. Alternatively, the printhead of a single printer could be equipped with several different printing devices (or devices with several different inks) and the job done over that number of printing operations. Obviously such operation would be very wasteful of the printer's time.

There is thus a clear need for digital printer configurations that would enable printing multiple images, of various sizes, at higher efficiency and considerably higher effective rates than possible with corresponding configurations of prior art.

SUMMARY OF THE INVENTION

The invention is of an improvement to digital printers of a wide range of configurations, according to which there are provided a plurality of printheads in a single printer, the printheads being operative to simultaneously mark corresponding images on corresponding areas of a single printable medium, or on corresponding objects of a plurality of objects within the printable range. Each printhead uniquely, i.e. exclusively, marks a corresponding image or group of images within the overall printing area. The printheads are thus disposed at substantial distances from each other—to conform with distances among the images or among groups of images. The printheads are arranged in a one-dimensional or two-dimensional array, preferably a regular array centered about Cartesian grid points, but may also have any arbitrary arrangement. Preferably the distances between the several printheads are adjustable according to the desired nominal distances between the corresponding images. It is noted that a printer according to the invention is primarily designed so that each printhead is operative to mark a medium within a corresponding window, all windows being mutually separate, though their respective sizes and their mutual geometric relations are adjustable. The term mutually separate is used here in the sense of covering mutually exclusive, non overlapping areas. This contrasts, inter alia, with the arrangement of interlacing marks made by various marking devices over the entire printed area, which is prevalent in known printers. Optionally, the windows may be made to butt with each other or to partially overlap, as may be desired for certain applications, but any such overlap would be a substantially small fraction of the size of any window.

It is to be appreciated that, for any given marking process and mode and any given printhead structure, the use of multiple printheads, printing simultaneously, as provided by the invention, commensurately increases the available overall rate of printing. Moreover, whenever a plurality of disjoint images are to be printed within the marking area of a given printer configuration, with substantial spaces between the images, the use of multiple printheads, printing within corresponding disjoint windows, increases the utilization efficiency of the printer, since no time is wasted by printheads sweeping over unprinted, non-image areas.

A digital printer according to the invention is based on a suitable configuration of a printer of prior art, such as described hereabove or any other type and configuration, using the same type of marking devices and the same mode of marking. It is noted that a printhead may include any number of marking devices, each device possibly including an array of marking elements (such as ink-jet nozzles or LEDs). In embodying the improvement, certain modifications of the underlying configuration are undertaken; these include:

- providing for the support and, possibly, the marking motion of the multiple printheads;
- possibly providing for holding or moving the media during marking within a suitably increased printing area; and
- providing a suitable plurality of sources of control signals for the multiple printheads.

Several configurations of a multiple-printhead printer are disclosed as exemplary embodiments of the invention, such configurations being related to the relevant underlying printer configuration. They include various combinations of any of the following mechanical concepts in forming an overall array of printheads:

(a) A plurality of printheads are mounted as a one-dimensional or two-dimensional array in an assembly, to be termed Multi-Printhead Assembly (MPA). Mechanical or electro-mechanical means are preferably included in the assembly so as to enable adjusting the nominal (e.g. center-to-center) distances between the printheads—along one or both dimensions, respectively; in the case of electro-mechanical means, also the generation of suitable control signals is provided for. A MPA may generally replace the single printhead in the underlying printer design and may accordingly be stationary or movable during marking. If movable along a rail, a second, parallel rail and motion assembly, supporting the MPA, may be added for mechanical stability.

(b) A plurality of printhead assemblies (PHAs), each including a single printhead or a plurality of printheads (as described above), are attached, each, to a carriage mounted on a rail, to be movable therealong, say along the X axis. The rail and the marking motion mechanism may be similar to those in an underlying printer configuration, but each PHA is preferably movable independently, though optionally they may share control signals for such marking motion. For mechanical stability, the rail may, again, be doubled. In the case of a two-axes printhead motion (as for example in a flat-bed configuration), the rail, or the double-rail assembly, is movable along the other axis—using, for example, a pair of base rails.

(c) A plurality of mutually parallel rails are provided, parallel to the X axis, along each of which one or more printheads or PHAs are movable. The motions along the several rails are preferably independent of each other, though they may optionally share motion control signals. The nominal distances between the rails are preferably adjustable by the inclusion of suitable mechanical or electro-mechanical means. In the case of a two-axes printhead motion (as for example in a flat-bed configuration), each rail is movable along the Y axis—using, for example, a pair of base rails; the motions of the several rails are preferably independent of each other, though they may optionally share motion control signals.

(d) Adjustability ranges of inter-printhead distances (whether within a MPA or between moving printhead-, PHA- and rail assemblies) are such that one or more printhead or PHA may be side-tracked and remain moot, leaving a reduced number of active printheads (e.g. to mark fewer but larger images).

(e) If the printable medium (or the substrate that carries printable objects) is flexible, either its path within the simultaneous marking range of all the active printheads is flattened—to conform to the plane of the printheads array, or any of the components of the overall array assembly is modified in shape, position or orientation so as to conform to the path of the medium.

(f) For the case that the printed surface is not flat—for example, curved surfaces of objects—any or all of the PHAs are also controllably movable along an axis that is generally normal to the underlying printing plane or substrate, so as to follow the surfaces while marking along the raster lines; in the case of multiple PHAs, they may be made to move along this axis (and others) together (as would necessarily be the case with the printheads within any single MPA), for imprinting identical objects, or there may be a configuration in which the various PHAs may move along the normal axis independently.

Optionally additional concepts may be included in a multi-printhead printer according to the invention; these include:

(g) Some of the printheads include printing devices of a different type than the other printheads or they may mark with different marking substances (e.g. inks), including those of different colors or such that are suitable for different types of media.

(h) Certain portions of the media (e.g. certain images) may be marked successively by several sweeps—for example, to mark in several colors when a drying time or a development stage must be interposed between the sweeps. It is noted that this concept, by itself, is shared with conventional printers (e.g. a multi-unit or multi-pass digital color printer) and is thus applicable to printers of the invention in conjunction with other concepts herein.

(i) As a combination of concepts (g) and (h), certain portions of the media (e.g. certain images) may be marked successively within different windows.

(j) Marking is carried out on an intermediate surface, from which the images are subsequently transferred, directly or indirectly (such as by a so-called offset process), to receptive media, which are the media being printed. It is noted that also this concept, by itself, is shared with certain conventional printers.

While the preferred mode of operation of printers constructed according to the invention is printing disjoint images, there may arise occasions and applications in which their multiple printhead feature may be advantageously utilized also when several image areas that are marked respectively by several printheads abut, to form a continuous image; for this case the respective marking windows mutually abut or possibly overlap within joint boundary regions. It is to be appreciated that even with such a mode of operation, a printer according to the invention, equipped with a given overall number of marking devices, is still clearly distinguishable from, and has advantages over, known printers of any configuration that includes head motion or slow motion of the medium—even if its single printhead is equipped with an equal number of similar marking devices operating simultaneously, because in the printer of the invention the devices are more evenly distributed over any given printable area, requiring commensurately less motion to cover it. The advantage may be particularly pronounced in printers of very large media formats.

It is noted that a printer according to the invention is distinguished from a conventional multi-stage digital color printer, even though the latter includes a plurality of printheads, each marking (a respective color component) within its own window (i.e. impression station), because in the latter each printed portion of the media passes through all the windows and is generally imprinted by their respective printheads, whereas in a printer of the invention, several distinct portions of the media are imprinted by corresponding distinct printheads within respective distinct windows (or, when concept (i) above is incorporated—by distinct groups of printheads and their windows).

It is further noted that a printer according to the invention is distinguished from any setup in which a plurality of conventional printers are made to operate in parallel or in tandem, in that the printer of the invention comprises a single coherent assembly and all the media to be multiply imprinted are mechanically handled together while being thus printed, as well as while being loaded to, or unloaded from, the printing area.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF SPECIFIC EMBODIMENTS

Figure 1:
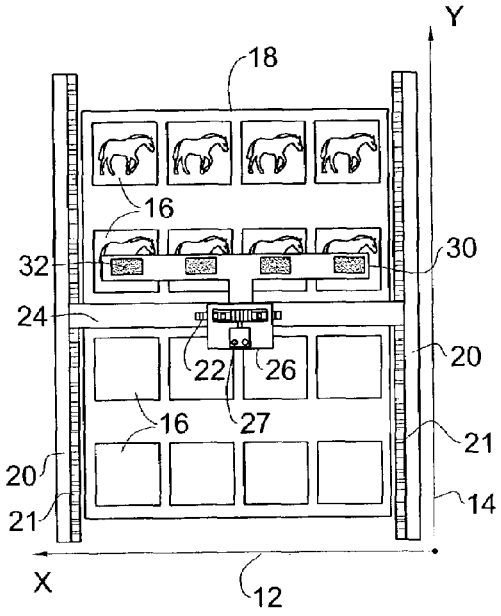
FIG. 1 is a schematic plan view of a printer according to the invention that includes a single four-printheads assembly movable along a first one or both of two orthogonal axes and media movable along the second orthogonal axis.

The fundamental feature of an apparatus of the present invention, in any configuration, is that it includes a plurality of printheads, disposed at a substantial distance from each other and operative to print simultaneously—each within a respective window over the medium, the several windows being separate. The term "substantial distance" means that generally the distance is essentially greater than that required merely by heads assembly considerations and is dictated by the spacing of images to be printed. The meaning of the term "separate" is that the windows are mutually exclusive, i.e. each window consists of a single contiguous area and no two windows overlap over any substantial portions of their respective areas. Clearly, the marks produced in any two windows by corresponding printheads cannot interleave. The exclusivity of the windows is not necessarily imposed by the structure of the apparatus or by any mechanical constraints, but rather is a fundamental mode of operation according to the invention. Moreover, the definition of window boundaries is preferably flexible and dynamic, so that window sizes and locations, as well as their number, may vary from one printing job to another. The windows may be arranged along a single coordinate axis or in any two-dimensional relationship; the latter is preferably but not necessarily according to a regular rectangular grid.

The invention will be described in terms of several exemplary configurations, but these should not be construed as exclusive or limiting. All the configurations herein described are based on typical configurations of digital printers as described above in the background section. With obvious modifications, the invented apparatus may also be based on other printer configurations and variations thereof. Moreover, while the embodiments described hereunder assume a type of printhead that is operative to be moved relative to the medium in order to effect traces thereon (such as based on ink-jet marking or on any array structure), the invention is equally applicable to printers employing other types of printheads, including those that require only single-axis motion (such as those involving a sweeping beam, e.g. a laser beam). It is noted that, as with hitherto-proposed printers, each printhead may include a plurality of marking devices, each one marking a plurality of traces. The marking devices may be of any type and based on any marking process, such as mentioned in the background section above, including but not limited to ink-jet (of any variety), radiative exposure (at any wavelength), charged-particle beams, contact heating (including transfer film), painting (by contact or by air-brush) and mechanical impact. The material deposited on the media as a result of the printing may be of any kind and having a variety of effects, including but not limited to optical attenuation (which is the commonly understood effect of printing and may be wavelength selective, i.e. colored), other optical effects (such as specularity or fluorescence), protective coating, texture, resist layer (for subsequent processes, such as chemical or radiative). The several devices in a printhead may include devices that mark in mutually different colors, or with mutually different materials and effects. The media to be printed by the apparatus of the present invention may likewise be of any type and made of any material, including but not limited to paper, cardboard, plastic- or metal sheets or plates, textiles and ceramics. Clearly there is some relationship between the type of printing process, the deposited material and the type of media. Another aspect of the printing process is the manner of depositing the effective material on the media; it may be deposited in real time as part of the marking process (as is usual with ink-jet printing or by transfer from a film), or deposited in bulk, subsequently to the marking process, to "develop" a latent image, such as marked by a radiative or electrically charging printhead. Moreover, this deposition (whether in real time or in a "development" stage) may be made directly on the media or made first on an intermediate carrier and the material transferred therefrom, directly or indirectly (e.g. offset), to the media. Any such process and manner of deposition may be used in printers of the present invention. In the last-mentioned case, the terms "medium" and "media" as used in the description and claims are to be understood as referring to the intermediate carrier.

In what follows, a number of configurations and variations thereof will be described. It should however be understood that many more configurations and variations are possible—all coming within the scope of the invention, if they include the fundamental features discussed above. Each configuration or variation may be optimally applicable to particular underlying mechanical configurations, particular printing processes or particular types and shapes of media; their choice may also depend on particular parameters associated with any of the aforementioned. In the illustrations and in the following description, a flat-bed is assumed as the mechanical configuration for media support and transport. This should, however, not be construed as limiting and adaptability of any of the disclosed configurations to other media support and transport mechanisms, if applicable, may be readily understood by persons knowledgeable in the art. Moreover, the illustrations show a basic configuration that is based on raster-forming motion of the printheads along two axes, thus assuming the media to be stationary during marking; configurations with marking motion of the media, while printheads move along one axis only (if at all), should however be readily understood therefrom. In the case of a web-like medium, in particular, the transport system will have to be modified so that the active printing area will extend to conform with any multi-row printhead configuration presented below. Likewise, the assumed marking process is an ink-jet process, but any other marking process, such as discussed above, should be readily applicable. Printheads of any type are represented in the drawings schematically by squares; clearly, their actual shapes would generally be different. Finally, the illustrated marking mode is that which involves two-axes motion between the printhead and the medium; it will be appreciated, however, that the embodiments hereunder are readily adaptable to marking modes involving single-axis motion, or no motion at all. It is also noted that while the drawings show arrays of tiles as the media to be printed, the array being carried by a substrate, it should be understood that the tiles here serve for illustration only and that the apparatus according to the invention may be used for printing any other medium, whether single or formed as a mounted array.

It is noted that mechanisms for moving printheads, printhead assemblies or media, as well as for assembling printheads together, discussed below and shown in the figures, are illustrative only and any such mechanisms are possible in printers of the invention, their nature and details being obvious to persons knowledgeable in the art. Any electrical driving circuits, both for the moving mechanisms and for actuating the printheads, are not shown in the drawings but should be understood as being part of the respective mechanisms or printheads.

As was discussed in the background section above, there are various ways of loading and unloading the media to and from the printer, including transfer from or to other printers, or other workstations. Any manner of loading and unloading may be employed with a printer of the invention, as suitable for its configuration; loading and unloading methods and mechanisms are, however, not part of the invention.

The configurations of the invented apparatus are described hereunder in terms of the three mechanical arrangements discussed above in the background section, in a logical order—beginning with the second arrangement, continuing with the first arrangement and ending with the third arrangement.

A preferred embodiment of a first general configuration of the invented apparatus is shown, in plan view, in FIG. 1. This is based on a digital printer of the second basic arrangement, in which printheads move fast along a first axis 12, say the X axis, while the media move slowly along the second, orthogonal, axis 14—say the Y axis. The exemplary underlying printer configuration, serving for illustration, is that of a flat bed and the exemplary medium in the configuration of FIG. 1 is a set of tiles 16 mounted on a horizontal flat substrate 18. For illustration, the exemplary tiles form a 4×4 rectangular array, spaced d units center-to-center (where d is greater than the size of a tile), and the substrate is in a horizontal plane and movable along the Y axis from front to back, supported by a fixed frame 20. The array of tiles may be regarded as consisting of four rows oriented along the X-axis and four columns oriented along the Y-axis. A rail 22 is mounted on a bridge 24 that spans the substrate, oriented along the X-axis, and a multi-printhead assembly 30 is attached to a carriage 26 that is slidable along rail 22 over a distance of at least d units. The sliding motion may be effected by any means known in the art, such as a motor 27 that is mounted on carriage 26 and turning a gear wheel or a belt drive (not shown). The multi-printhead assembly (MPA) 30 of FIG. 1 includes four printheads 32 disposed d units apart (center-to-center) along the X-axis. In operation, the MPH is made to repeatedly move from left to right a certain distance that exceeds the size of a tile and to return. Meanwhile, the substrate is made to move from front to back—either in a slow continuous motion or stepwise. During the left-to-right motion, each printhead is made to mark on the tile under it a strip, w units wide. The speed or step size of the substrate's motion is such as to cover w units of travel during a cycle of the MPA motion. During stages of feeding- and delivering the substrate, the motion of the substrate may be speeded up. If the printing is in color, each printhead typically includes a plurality of marking devices, variably supplied with colored inks; these are generally positioned so as to be mutually offset in the direction of substrate motion. In this case, any strip of image is printed successively in the various colors, but the overall operation remains as described. Clearly, this arrangement of printheads, operating as described, causes four images to be printed simultaneously—one along each column of the tiles array, by means of the respective printhead in the MPA.

It will be appreciated that the bridge, the carriage and the rail have been mentioned above only as typical means for holding the MPA and causing its motion to be confined to a track and that other means for that effect, whether or not currently known in the art, are equally applicable within the scope of the invention. Moreover, any means and method for moving the MPA along the track may be utilized, many of them being well known in the art. Likewise, any means for moving the media or the substrate are applicable within the scope of the invention. It is noted, moreover, that the track of the MPA need not be straight, but could, for example, be arcuate or circular—e.g. to conform to a cylindrical formation of the media or the substrate. Alternatively, the motion of the media need not be along a straight line, but could, for example, conform to some underlying curved surface. The latter situation may occur particularly when the medium or the substrate is a sheet or continuous web that moves through a printing area backed by a support surface—fixed or rolling. Generally, the means and methods for holding and moving the MPA are similar to those used for holding and moving a single printhead in any prior-art digital printer having a similar basic configuration; likewise, the means and methods for moving the medium or the substrate are similar to those used for moving them in any prior-art digital printer having a similar basic configuration. Any necessary modifications to such means and methods should be evident to persons knowledgeable in the art. It is further noted that, in general, a plurality of PHAs could be attached to a single carriage; since however they would move together, they are considered in the context of the invention to jointly form a single MPA.

Figure 2:
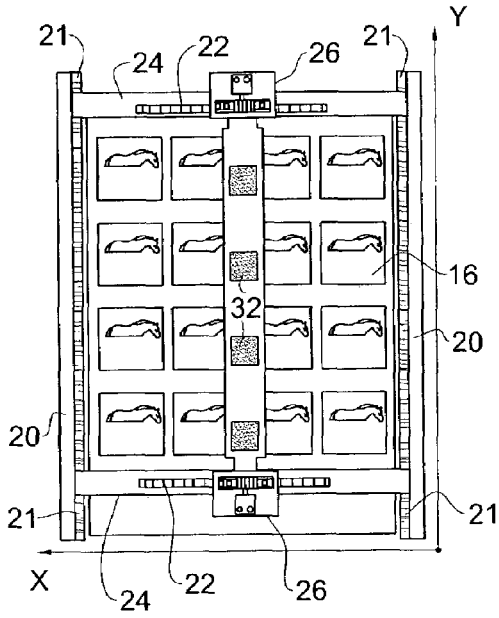
FIG. 2 shows a different configuration of the printer of FIG. 1.

A preferred embodiment of a first variation of the first configuration is shown, in plan view, in FIG. 2. This is similar to that of FIG. 1 except that the four printheads 32 in the MPA 30 are now disposed, again d units apart, in a front-back direction and the rail 22 on each of two bridges 24 is at least 4d units long. The MPA may be suspended, say at its middle, from a carriage slidable along a single rail, mounted on a dingle bridge, or it may be attached to two carriages 26, slidable on respective two parallel rails 22, mounted on respective bridges 24, as shown in FIG. 2. In operation, MPA 30 is made to move across the entire width of the tiles array and thereby to print four rows of tiles simultaneously. The substrate is made to meanwhile move slowly over d units, whereupon the entire array is printed. After that the substrate is moved to the back for unloading and a newly loaded substrate is positioned—to be printed similarly to the previous one.

Figure 3:
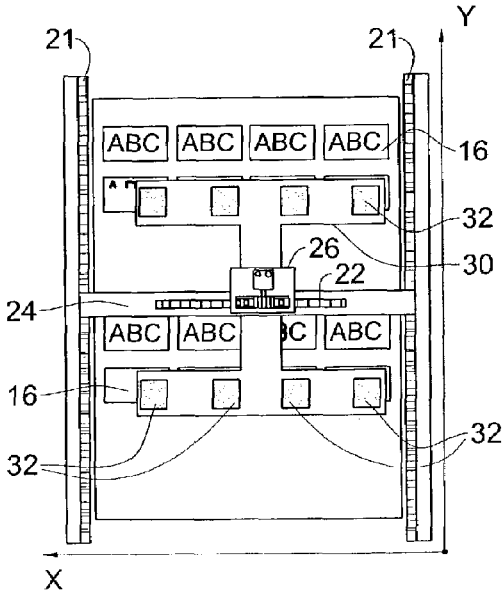
FIGS. 3 and 3*a* show another different configuration of the printer of FIG. 1, with an eight-printheads assembly.
Figure 3A:
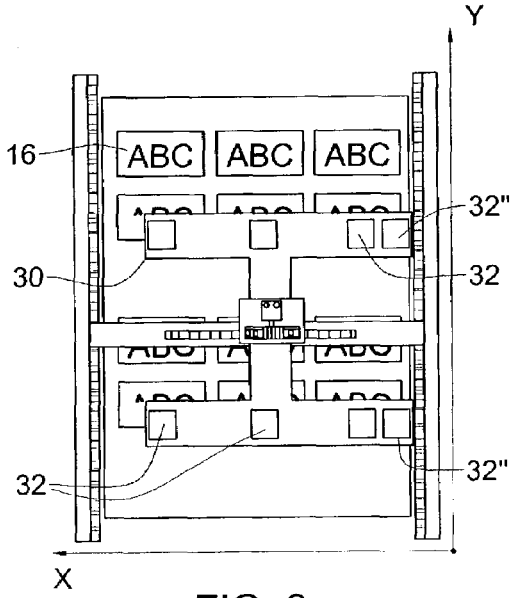

In a second variation of the first configuration, shown in plan view in FIGS. 3 and 3A, the eight printheads 32 in the MPA 30 are disposed in a two-dimensional array—for example, as two rows and four columns. In this case eight tiles are printed simultaneously—two rows at a time and the substrate is moved each time to a new position. The rows may be spaced d units apart, in which case two adjacent rows of tiles are printed simultaneously, or the rows may be spaced 2d units apart, in which case alternate rows of tiles are printed simultaneously, etc. The MPA of FIGS. 3 and 3A exemplifies another format for the 2×4 array of printheads, in which the rows are spaced apart by approximately half the length of the active printing area. The exemplary media illustrated in FIG. 3 consist of tiles 16 with a shorter Y dimension than in the previous examples, so that six rows fit in the length of the printable area; accordingly, the rows of the MPA are spaced three row distances apart. Again, two rows of tiles are printed simultaneously and then the medium moves for the next pair of rows to be printed, etc. As will be explained further below, the distances between printheads in any row are preferably adjustable. In FIG. 3 there are four tiles across the array and the positions of the four printheads 32 in each row of MPA 30 are adjusted so that all printheads are aligned with their respective underlying tiles. It is noted, though, that this is alignment need not be strict if the print control signals to the various printheads are independent and could be timed in relation to their actual positions relative to the tiles. The distances between the printheads are preferably adjustable to such an extent that they may also conform to image arrays having more or fewer (and accordingly smaller or larger) images across the span of the MPA. In such a case, one printhead (or more) would be moved to an extreme position and be inactive. An exemplary case is illustrated in FIG. 3A for the configuration of FIG. 3, wherein there are only three columns of tiles, each wider than in the previous case. Accordingly, the rightmost printheads 32" are shown moved to the ends of the respective arms and made inactive (as indicated by the white squares representing them in the drawing); the positions of the remaining three printheads on each arm (indicated in the drawing, as usual, by gray tone) are shown adjusted to align with the respective tile columns.

Figure 4:
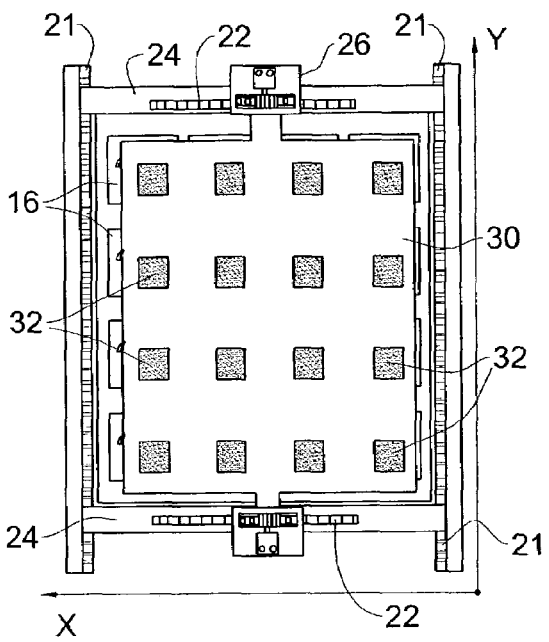
FIG. 4 show yet another configuration of the printer of FIG. 1, with a single sixteen-printheads assembly.

In a third variation of the first configuration, shown in plan view in FIG. 4, the MPA 30 is formatted so as to include an array of printheads 32 to cover the entire printable area, the printheads spaced to conform with the expected image positions, which enables printing all images simultaneously. In the illustrated example the array is 4×4 printheads 32—to simultaneously print an array of 4×4 tiles 16. In this case no MPA- or medium repositioning is necessary between the medium loading and unloading operations.

It is to be noted that in each of the configurations above, as well as those to be described below, each printhead of the MPA prints, in effect, within a respective rectangular window, whose dimensions are determined by the range of active printing of each printhead during motion of the MPA and of the medium or substrate between successive positioning actions. Thus, for example, each printhead in the configuration of FIG. 1 prints within a window d units wide and 4d units long. Similarly the windows in the configuration of FIG. 2 are 4d units wide and d units long. In the case of FIG. 3, each printhead marks within a window that is one tile-width wide and three tile-lengths long. In the case of FIG. 4, there is, in effect, a window for each tile, each window being, in this example, a square of d units on each side. Other window sizes, including non-square shapes, are also possible.

It will be appreciated that parameters other than those in the above examples are possible. Thus, the printhead array on the MPA may have any other number of printheads and have any other format. Likewise, the printed media need not be physically separate entities, such as tiles and pieces of garment, but may be in the form of a single sheet each, on which a plurality of mutually exclusive images are printed. Also, the distances along the two orthogonal axes need not be identical. It is also to be noted that the images printed by the several printheads need not be identical; on the contrary, the various printheads could be fed different signals, causing the printing of different images. A special case of the latter situation is the printing of a single large image, whereby each printhead prints a designated portion thereof; adjacent portions are usually positioned in abutment, so as to visually merge together. Clearly, any image may also be blanked out.

In a modification of any of the configurations, suitable for specific applications, the array of printheads on the MPA is not necessarily aligned with the motion axes, but may be inclined to them, so that the resulting images do not fall on a grid aligned with the axes. Moreover, the centers of the printheads themselves need not be mutually aligned.

Figure 5:
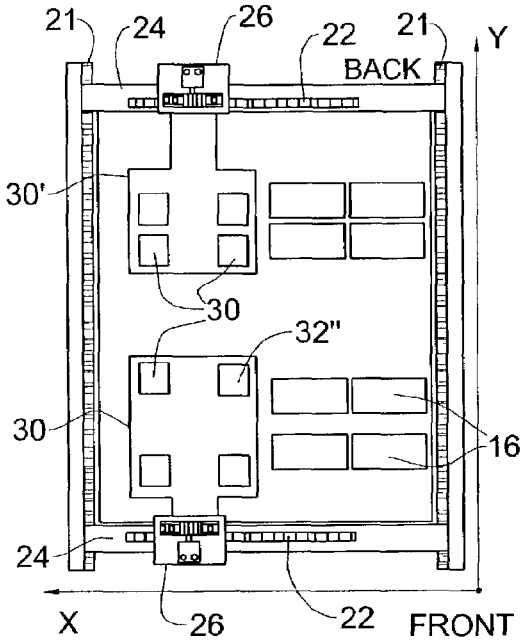
FIG. 5 is a schematic plan view of a printer according to the invention that includes two four-printheads assemblies, each movable along two orthogonal axes.
Figure 6:
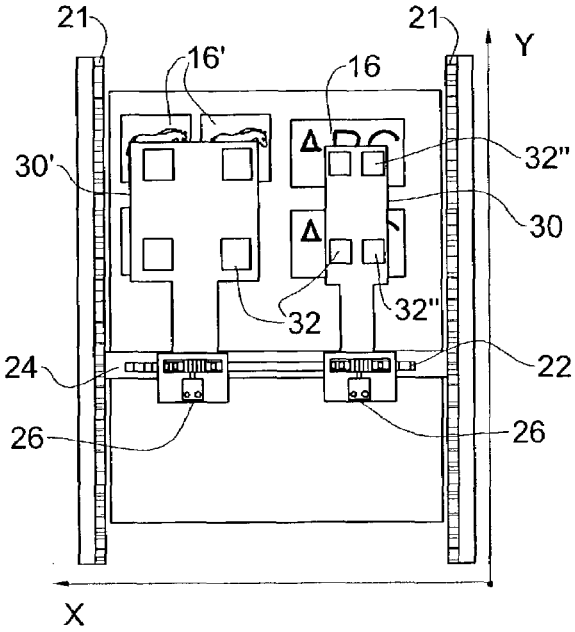
FIG. 6 shows a different configuration of the printer of FIG. 5.

Preferred embodiments of two versions of a second configuration of the apparatus according to the invention, likewise based on the second basic mechanical arrangement of digital printers, are shown, in plan view, in FIGS. 5 and 6, respectively. In this configuration there is a plurality of printhead assemblies. Each printhead assembly (PHA) may include one or more printheads; if more than one, the PHA is in effect a MPA. In each of the examples of FIGS. 5 and 6, there are two PHAs and each PHA includes 2 or 4 printheads. Each PHA is attached to a carriage, movable along a rail—similarly to the MPA in the configurations described above, and also their mode of operation is generally similar, except as discussed below. In the version of FIG. 6, two PHAs 30 are attached to respective carriages 26 slidable along a common rail 22 (or along separate collinear rails) on a common bridge 24 and windows are divided left-right between the PHAs. Thus, for the exemplary tiles array, the right-hand PHA 30 prints the right-hand column of tiles 16, while the left-hand PHA 30' prints the two left-hand columns of tiles 16'. In the version of FIG. 5, two PHAs 30 and 30' are attached to respective carriages 26, slidable along widely separate rails 22, and windows are divided front-back between the PHAs. In this case, the PHA 30 near the front prints the two rows of tiles 16 nearer the front, while the PHA 30' near the back prints the two rows nearer the back. Clearly, the respective versions of FIG. 5 and FIG. 6 may be combined—to form a version (not shown) wherein there are a plurality of rails, to each of which is slidably attached a plurality of PHAs. Distances between plural printheads (when provided) on any PHA may be made adjustable, as in the first configuration; moreover, in the version of FIG. 5 the distance between the rails (or supporting bridges) may be made adjustable—again, by means known in the art.

As in the single MPA of the first configuration, certain ones of the printheads on any MPA in the second configuration, may be selected to be inactive during any particular job, so that only the remaining printheads have printing windows associated with them. Thus, in the examples of FIGS. 5 and 6, only the two left-hand printheads (marked by gray tone) of one MPA 30 in each case may be made active—to print a plurality of tile columns each or to print wider tiles than those illustrated, while the two rightmost printheads 32" in these MPAs (marked by white), remain inactive. FIGS. 5 and 6 also illustrate the possibility that not all MPAs are of the same size and of the same format of included printheads; thus, in the example of each drawing, MPA 30 is different from MPA 30'.

The PHAs of FIG. 6 may be mechanically coupled, for example—by means of a common drive belt. Likewise, the PHAs of FIG. 5 may be mechanically coupled, for example—by means of a common axle connecting between the drive wheels of the respective drive belts. Clearly, in the above-mentioned combined version, the PHAs may be mechanically coupled along both axes. With such an arrangement, the coupled PHAs may be regarded as effectively forming a single MPA and the modes of operation, described above with respect to the first configuration (and its variations), are equally applicable. The coupling mechanism along either axis may be modified to make respective distances between the coupled PHAs adjustable.

Generally, however, the PHAs of FIGS. 5 and 6 may be moved independently, by means of separate drive mechanisms and corresponding drive signals. Such an arrangement may be useful, for example, in cases that the sizes of images to be printed in various rows or columns of the media array vary, so that changing the corresponding inter-row or inter-column distances d may result in suitably sized windows, leading to more efficient use of the overall printable area. It is to be noted that identical drive signals may be fed to the drive mechanisms of the PHAs, causing them to move identically and together—again forming, in effect, a single MPA; in this case, electronic means may be conveniently applied to effect adjustability of inter-PHA distances.

The configurations as illustrated in FIGS. 1-6 are based on the flat-bed version of the second basic mechanical configuration of digital printers, as described in the background section, namely wherein the medium moves slowly along the Y axis, while the printhead generally moves repeatedly along the X axis, in a relatively fast motion. If the underlying media configuration is of the web type, the plate, which in the illustrated example carries an array of tiles, is replaced by a web, running from front to back by means of drive cylinders outside the print area. Within the print area the web is usually be supported by a backing structure. The configurations of FIGS. 1-6 are, in essence, equally applicable; however, in the case of a multi-row MPA, or of multiple PHAs along the Y axis (as in FIG. 5), the print area is appreciably wider (in the front-back dimension) than in the conventional printers and the backing structure has to be designed accordingly. The backing structure may then be advantageously made to have an essentially curved surface; in this case, printheads on different rows may have to be differently mounted on the MPA, and various PHAs differently oriented, so as to aim normally to that surface.

We now turn to the first basic mechanical arrangement of printers, as described in the background section, namely that in which the media are stationary during printing and the printhead moves along both orthogonal axes. Such printers are almost exclusively formed as a flat-bed. The apparatus of the invention may then be embodied in a variety of configurations that greatly resemble those based on the second basic arrangement and discussed above with reference to FIGS. 1-6, except that each bridge is now made to be movable in the front-back direction, while the media or the substrate are kept stationary and are moved only during loading and unloading operations. The motion of the bridges is generally the slow one—in effect replacing the motion of the medium in the second arrangement. Thus in embodiments illustrated, again, in FIGS. 1-6, for example, there are provided a pair of rails 21, attached to the side frame 20, along which the one or two bridges 24 (as the case may be) move. Clearly, in the configurations of FIGS. 2 and 4 the two bridges must move together as a unit and thus are preferably mechanically coupled. However, in the configuration of FIG. 5, there is no such requirement and the two bridges may move independently. In fact, such independent motion may be used to advantage if, for example, the tiles to be printed by the corresponding MPAs are of different sizes—requiring differently sized windows. Clearly, the inter-printhead distance adjustment mechanisms discussed above are valid for these configurations as well.

For the third basic mechanical arrangement of printers, namely that in which the medium moves relatively fast while the printheads move relatively slowly, any of the configurations described above are theoretically adaptable. However, since the fast medium motion is usually achieved by cylindrical rotation, only those with a single row of printheads, oriented along the slow axis, is deemed to be practical, since there can be no physically manifestable windows structure in the front-back direction. These may include, for example, the configuration with one single-row MPA, similar to that discussed with reference to FIG. 1, and the configuration with multiple PHAs along a single bridge; the latter would be similar to that discussed with reference to FIG. 6, except that in each PHA there would be a single printhead or a single row of printheads. It is to be noted that such configurations according to the present invention are distinct from multi-printhead configurations with a rotating drum, of prior art, in that the printheads of the latter are essentially stationary, in contrast to the inherent motion (slow, left-right) of printheads in the apparatus of the present invention; motion of printheads in some prior art models has a very limited range and is aimed merely at interlacing the traces, e.g.—at building up traces in the gaps between adjacent nozzles; the latter mode of operation is clearly distinct from the concept of separate windows that is fundamental to the present invention.

Figure 7:
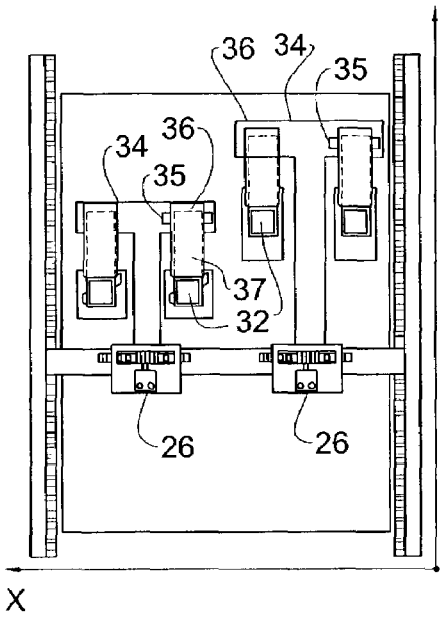
FIGS. 7 and 7*a* are schematic plan views of two configurations of a printer according to the invention that includes two two-printheads assemblies, showing adjustability of inter-printhead distances.
Figure 7A:
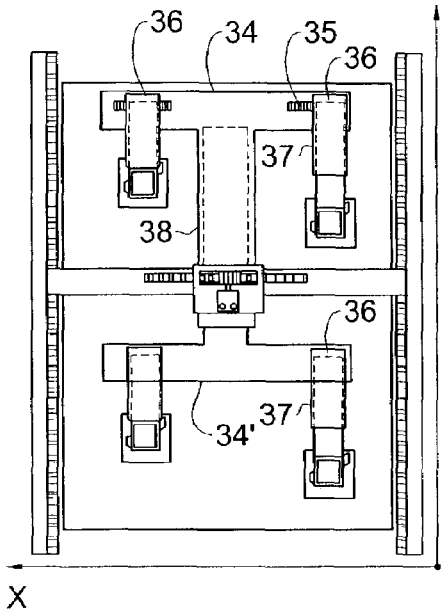

In a modification of any of the configurations, the distance d between any adjacent printheads in a MPA, along one or both of the axes, is variable, so as to suit any desirable center-to-center distance between printed images and corresponding maximum image sizes. In the above example of tiles, this may be useful in order to fit a maximal number of tiles on the substrate even though their size is variable. Any mechanical or electromechanical device known in the art may be applied to effect such variability of inter-printhead distance. Two exemplary configurations of inter-printhead distance adjustment mechanisms are illustrated schematically in FIGS. 7 and 7A. The configuration of FIG. 7 is based on that of FIG. 6, albeit with only two printheads 26 per MPA. Here each of the two MPAs comprises a carrier 34, which is attached to the respective carriage 26 and to which, in turn, are attached two riders 36 by means of respective slide-and-lock mechanisms 35, which enable left-right adjustments (along the X-axis). To each rider is attached a corresponding printhead, by means of a similar slide-and-lock mechanism 37, which enables front-back adjustments (along the Y-axis). The slide-and-lock mechanism may be replaced by an electrically activated lead-screw mechanism or any other means known in the art. The configuration of FIG. 7A is based on that of FIG. 3, except that the single MPA includes only four printheads—two on each arm. It has three adjustment mechanisms, each similar to those in FIG. 7: One of them, 38, serves to adjust the distance between the two rows, along the Y axis, by causing the two corresponding carrier arms 34 and 34' of the MPA to slide relatively to each other. To each of the two carrier arms are attached two riders 36 through a similar adjustment mechanism 35, to determine their positions along the X axis (as in FIG. 7). To each rider 36 is in turn attached a printhead 32, at least one of them—through another one adjustment mechanism, 37, which allows sliding one of the printheads, 32, with respect to the carrier 34 along the Y axis, thus enabling relative Y adjustment between the two printheads in a row.

Figure 8:
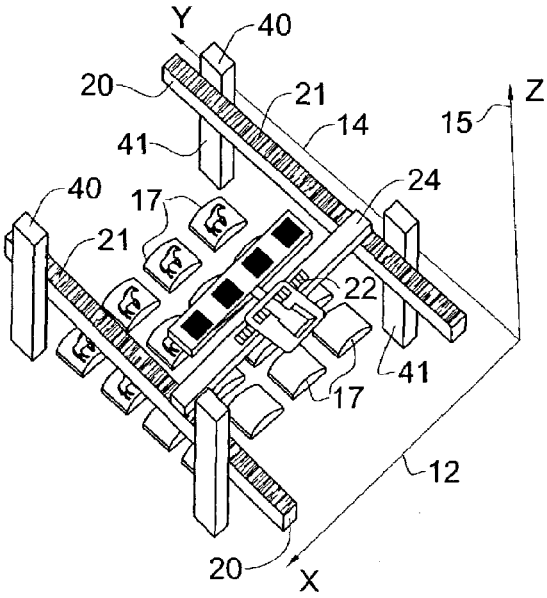
FIG. 8 shows a modification of the printer of FIG. 1, in which the multi-printhead assembly is also movable normally to the plane of the two axes.

In the case of the modified mechanical arrangement that allows also motion of PHAs normally to the media plane (discussed in the background section), to enable printing curved surfaces, any of the configurations discussed above may be suitably modified. FIG. 8 illustrates, in isometric view, one exemplary configuration, which is based on a two-axes (X and Y) PHA motion configuration, with a four-printheads MPA, such as illustrated in FIG. 1. The exemplary media are objects 17 with curved surfaces. Here, again, the MPA slides on a rail 22 along the bridge 24, which, in turn, slides along side rails 21 on a frame 20. However the whole frame 20 is made to be slidable along the Z axis 15 by means of vertical rails 41 on four posts 40. Alternatively, the frame and side rails could be stationary, while the bridge is made to be slidable along rails on vertical posts that, in turn, slide along the side rails on the frame.

Figure 9:
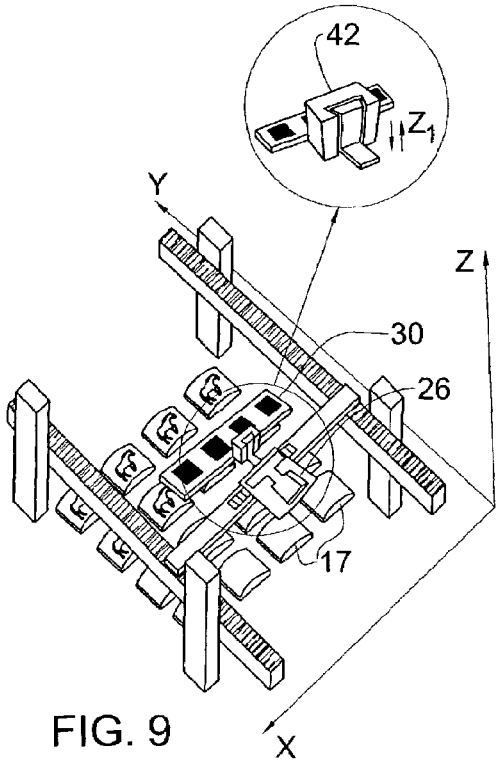
FIG. 9 shows a different configuration of the printer of FIG. 8.

Yet another exemplary derived configuration for three-dimensional printhead motion, which is based on that of FIG. 1, is illustrated in FIG. 9. Here, the frame, side rails and bridge are similar to those of FIG. 1; however, each MPA 30 (which in the illustrated example is single), is slidably attached to its respective carriage 26 by means of a vertical rail mechanism 42 (shown enlarged within an inset in the drawing), along which the respective MPA moves along the Z axis. In operation, the bridge moves slowly in the Y direction, as before; each MPA moves fast, back and forth, along the X axis and at the same time it also moves up and down in conformity with the curved surfaces of the corresponding objects being printed. Clearly, in the arrangement of FIG. 9 various MPAs (if included) may imprint objects of different shapes, as well as sizes.

In any of the configurations discussed above, the mode of operation may be such that any printhead may traverse any portion of the media more than once. This may be required, for example, when printing several colors within the same window and there must be a time interval between applications of the various colors. Another mode of operation possible with any of the configurations is for any portion of the media to be imprinted successively within several different windows. This may, for example, be the case when different colors are printed within the several windows. Both of the last discussed examples of operational modes are shared with conventional color printers; printers according to the invention are, however, characterized in the first case by a plurality of such multicolor windows (with their corresponding printheads) and in the second case—by a plurality of such multicolor groups of windows (with their corresponding printheads).

Finally it is to be noted that not all the printheads in any one printer need be identical. Aside from color differentiation, as discussed above (in which case the same portion of media is imprinted by several different printheads), there may be applications in which different portions of media must be imprinted differently. For example, in the case of ink-jet printing, if various objects or portions of an object have different surface materials, they have to be imprinted with suitably different inks; in such a case they are assigned to suitable separate printheads and printed within corresponding windows. Such an application is thus particularly advantageously served by a multi-printhead printer.

The invention claimed is:

1. A digital printer comprising at least two printhead assemblies that are independently movable relative to each other along at least a first axis, each printhead assembly including at least two printheads supported by a common carriage, each printhead including one or more printing devices, all of said printheads in each printhead assembly being operative for marking substantially simultaneously within respective non-overlapping windows relative to one or more media, said marking by any printhead over the entire respective window requiring relative motion between the corresponding printhead assembly and the media along each of two mutually orthogonal axes, the motion along one of said axes being repetitive.

2. The digital printer according to claim 1, wherein said printheads in any of the printhead assemblies are disposed at substantial distances from each other.

3. The digital printer according to claim 1, wherein each printhead is operative to mark one or more images, images marked by different printheads being distinct from each other.

4. The digital printer according to claim 3, wherein said images are mutually disjoint.

5. The digital printer according to claim 4, wherein at least two of the images are identical.

6. The digital printer according to claim 3, wherein at least two of the windows abut one another and all the corresponding images are portions of one image.

7. The digital printer according to claim 1, wherein each printhead is operative to mark on a respective medium, all media being mutually separate.

8. The digital printer according to claim 1, wherein a respective size of at least two of the windows is adjustable.

9. The digital printer according to claim 1, wherein the windows are of different size.

10. The digital printer according to claim 1, wherein the image marked by any printhead is a latent image.

11. The digital printer according to claim 1, wherein intermediate media are disposed in said windows, serving to transfer an image marked thereon by said printheads, directly or indirectly to image receptive media.

12. The digital printer according to claim 1, wherein any two printheads include different types of printing devices.

13. The digital printer according to claim 12, wherein marking by said different types of printing devices causes different materials to be deposited on the corresponding portions of media disposed in said windows.

14. The digital printer according to claim 12, wherein marking by said different types of printing devices causes different colors to be imprinted on the corresponding portions of media disposed in said windows.

15. The digital printer according to claim 1, wherein at least one of the printing devices is an ink-jet device.

16. The digital printer according to claim 1, wherein at least one of said printheads includes at least two printing devices, configured to mark in different colors.

17. The digital printer according to claim 1, further comprising at least one rail, disposed parallel to said first axis, and, corresponding to each rail—at least one carriage that is slidably attached to the rail, each carriage having a printhead assembly attached thereto, sliding of any carriage along the corresponding rail effecting motion of the respective printhead assembly along said first axis.

18. The digital printer according to claim 17, wherein movement of each carriage along a corresponding rail is independently controllable.

19. The digital printer according to claim 17, wherein at least two of the carriages are slidably attached to a common rail.

20. The digital printer according to claim 17, wherein at least one rail is movable along a second axis, orthogonal to the first axis.

21. The digital printer according to claim 20, comprising at least two movable rails, whose respective movements are independently controllable.

22. The digital printer according to claim 1, wherein the printer comprises a single frame, the motion of all of the printhead assemblies being relative to said frame.

23. The digital printer according to claim 1, wherein all the printhead assemblies are movable along first and second mutually orthogonal axes.

24. The digital printer according to claim 1, wherein the media to be marked by the printer are movable along a second axis orthogonal to the first axis.

25. The digital printer according to claim 24, wherein combined movement of the printhead assemblies and the media causes marking to occur along lines essentially parallel to said first axis.

26. The digital printer according to claim 24, wherein combined movement of the printhead assemblies and the media causes marking to occur along lines essentially parallel to said second axis.

27. The digital printer according to claim 1, wherein a distance between any two printheads in any printhead assembly is adjustable.

28. The digital printer according to claim 1, wherein the printheads in any printhead assembly form an array, having at least one row.

29. The digital printer according to claim 28, wherein a distance between at least two printheads in at least one row is adjustable.

30. The digital printer according to claim 28, wherein the array has at least two rows, of at least two printheads each, and the distance between at least two rows is adjustable.

31. The digital printer according to claim 1, wherein any media, or any face thereof, while being marked, lie generally in a plane that is parallel to said first axis.

32. The digital printer according to claim 31, wherein at least one printhead assembly is also movable along an axis essentially normal to said plane.

33. The digital printer according to claim 32, wherein at least two of the printhead assemblies are independently movable along said normal axis.

34. The digital printer according to claim 32, wherein at least two of the printhead assemblies are jointly movable along said normal axis.

35. The digital printer according to claim 1, wherein each printhead assembly includes a carriage and said at least two printheads are fixedly attached to said carriage.

36. The digital printer according to claim 1, wherein all the printheads in any printhead assembly are configured in a rectangular grid.

37. A digital printer comprising at least one moveable printhead assembly that includes at least four printheads supported by a common carriage, each printhead including one or more printing devices, the printheads in each of said assemblies forming an array of at least two rows and at least two printheads in each row, all of said printheads in each printhead assembly being operative for marking substantially simultaneously within respective non-overlapping windows relative to one or more media, said marking by any printhead over the entire respective window requiring relative motion between the corresponding printhead assembly and the media along each of two mutually orthogonal axes, the motion along one of said axes being repetitive.

38. The digital printer according to claim 37, wherein said printheads are disposed at substantial distances from each other.

39. The digital printer according to claim 37, wherein each printhead is operative to mark one or more images, images marked by different printheads being all mutually disjoint.

40. The digital printer according to claim 39, wherein images marked by different printheads are all mutually identical.

41. The digital printer according to claim 39, wherein at least two of the images are identical.

42. The digital printer according to claim 39, wherein at least two of the windows abut one another and all the corresponding images are portions of one image.

43. The digital printer according to claim 37, wherein each printhead is operative to mark on a respective medium, all media being mutually separate.

44. The digital printer according to claim 37, wherein a respective size of at least two of the windows is adjustable.

45. The digital printer according to claim 37, wherein the size of at least one of the windows is different from the size of any other window.

46. The digital printer according to claim 37, wherein the image marked by any printhead is a latent image.

47. The digital printer according to claim 37, wherein intermediate media are disposed in said windows, serving to transfer an image marked thereon by said printheads, directly or indirectly to image receptive media.

48. The digital printer according to claim 37, wherein any two printheads include different types of printing devices or are adapted to mark with different marking substances.

49. The digital printer according to claim 37, wherein marking by any two printheads causes different materials to be deposited on the corresponding portions of media disposed in said windows.

50. The digital printer according to claim 37, wherein at least one of the printing devices is an ink-jet device.

51. The digital printer according to claim 37, wherein at least one of said printheads includes at least two printing devices, configured to mark in different colors.

52. The digital printer according to claim 37, wherein all printhead assemblies are movable parallel to at least a first axis.

53. The digital printer according to claim 52, further comprising at least one rail, disposed parallel to said first axis, wherein, corresponding to each rail, at least one of said carriages is slidably attached to the rail, sliding of any carriage along the corresponding rail effecting motion of the respective printhead assembly along said first axis.

54. The digital printer according to claim 53, comprising at least two of said printhead assemblies.

55. The digital printer according to claim 54, wherein movement of each carriage along a corresponding rail is independently controllable.

56. The digital printer according to claim 54, wherein at least two of the carriages are slidably attached to a common rail.

57. The digital printer according to claim 52, wherein any media, or any face thereof, while being marked, lie generally in a plane that is parallel to said first axis.

58. The digital printer according to claim 57, wherein at least one of the printhead assemblies is also movable along an axis essentially normal to said plane.

59. The digital printer according to claim 58, comprising a plurality of said printhead assemblies, at least two of which are independently movable along said normal axis.

60. The digital printer according to claim 58, comprising a plurality of printhead assemblies, at least two of which are jointly movable along said normal axis.

61. The digital printer according to claim 53, wherein at least one rail is movable along a second axis, orthogonal to the first axis.

62. The digital printer according to claim 53, comprising at least two movable rails, whose respective movements are independently controllable.

63. The digital printer according to claim 37, wherein the printer comprises a single frame, the motion of all of the printhead assemblies being relative to said frame.

64. The digital printer according to claim 63, wherein all the printhead assemblies are movable along first and second mutually orthogonal axes.

65. The digital printer according to claim 37, wherein all the printhead assemblies are movable along a first axis and media to be marked by the printer are movable along a second axis orthogonal to the first axis.

66. The digital printer according to claim 65, wherein combined movement of the printhead assemblies and the media causes marking to occur along lines essentially parallel to said first axis.

67. The digital printer according to claim 65, wherein combined movement of the printhead assemblies and the media causes marking to occur along lines essentially parallel to said second axis.

68. The digital printer according to claim 37, wherein a distance between at least two printheads in at least one row is adjustable.

69. The digital printer according to claim 37, wherein the distance between at least two rows is adjustable.

70. The digital printer according to claim 37, wherein all the printheads in any printhead assembly are configured in a rectangular grid.

71. A digital printer comprising at least two rail assemblies, each having one or more mutually parallel rails, and at least two printhead assemblies adapted to move independently along different ones of said rail assemblies, each printhead assembly having two or more printheads supported by a common carriage, adapted for motion along the respective rail assembly, each printhead including one or more printing devices, all of said printheads in each printhead assembly being operative for marking substantially simultaneously within respective non-overlapping windows relative to one or more media, said marking by any printhead over the entire respective window requiring relative motion between the corresponding printhead assembly and the media along each of two mutually orthogonal axes such that motion along one of said axes is repetitive.

72. The digital printer according to claim 71, wherein movement of each printhead assembly along a corresponding rail is independently controllable.

73. The digital printer according to claim 71, wherein each printhead assembly is attached to a corresponding carriage, which is slidably attached to the corresponding rail, and sliding of any carriage along the corresponding rail effects motion of the corresponding printhead assembly along said rail.

74. The digital printer according to claim 71, wherein each of said rails is movable along an axis orthogonal to a longitudinal axis thereof.

75. The digital printer according to claim 74, wherein movement of each of said rails is independently controllable.

76. The digital printer according to claim 71, wherein each printhead is operative to mark on a respective medium, all media being mutually separate.

77. A digital printer comprising at least one moveable printhead assembly that includes a carriage and at least four printheads fixedly attached thereto, each printhead including one or more printing devices, the printheads in each of said assemblies forming an array of at least two rows and at least two printheads in each row, all of said printheads in said printhead assembly being operative for marking substantially simultaneously respective images on one or more media, all of said images being mutually identical and non-overlapping.

78. The digital printer according to claim 77, wherein all of said images are mutually disjoint.

79. The digital printer according to claim 77, wherein at least one of said printheads includes at least two printing devices, configured to mark with different marking substances.

80. The digital printer according to claim 77, wherein all the printhead assemblies are movable along first and second mutually orthogonal axes.

81. The digital printer according to claim 77, wherein all the printhead assemblies are movable along a first axis and media to be marked by the printer are movable along a second axis, orthogonal to the first axis.

82. The digital printer according to claim 77, wherein a distance between any two printheads in any printhead assembly is adjustable.

* * * * *